US007323087B2

(12) United States Patent
Beck

(10) Patent No.: US 7,323,087 B2
(45) Date of Patent: Jan. 29, 2008

(54) ANTI-REWET FELT FOR USE IN A PAPERMAKING MACHINE

(75) Inventor: David A. Beck, Appleton, WI (US)

(73) Assignee: Voith Paper Patent GmbH, Heidenheim (DE)

( * ) Notice: Subject to any disclaimer, the term of this patent is extended or adjusted under 35 U.S.C. 154(b) by 487 days.

(21) Appl. No.: 10/810,454

(22) Filed: Mar. 26, 2004

(65) Prior Publication Data

US 2004/0180596 A1 Sep. 16, 2004

Related U.S. Application Data

(63) Continuation of application No. PCT/EP02/10771, filed on Sep. 25, 2002, which is a continuation of application No. 09/964,720, filed on Sep. 27, 2001, now Pat. No. 6,616,812.

(51) Int. Cl.

| | |
|---|---|
| ***D21F 3/04*** | (2006.01) |
| ***D21F 7/08*** | (2006.01) |
| ***B32B 5/02*** | (2006.01) |
| ***B32B 5/26*** | (2006.01) |

(52) U.S. Cl. ..... 162/205; 162/358.1; 162/358.2; 162/360.3; 162/900; 428/137; 442/286; 100/121

(58) Field of Classification Search ..... 162/358.1, 162/358.2, 205, 206, 116, 348, 900, 902, 162/903, 358.5, 360.3, 359.1; 34/95, 116, 34/123; 100/155 R, 37, 118, 121; 28/110, 28/142; 442/286–294; 428/131, 137, 138
See application file for complete search history.

(56) References Cited

U.S. PATENT DOCUMENTS

| | | | | |
|---|---|---|---|---|
| 4,309,246 | A * | 1/1982 | Hulit et al. | 162/113 |
| 4,541,895 | A * | 9/1985 | Albert | 162/348 |
| 4,675,079 | A * | 6/1987 | Webster | 162/360.3 |
| 5,232,768 | A * | 8/1993 | Eklund et al. | 442/225 |
| 5,525,410 | A * | 6/1996 | Hansen | 442/197 |
| 5,609,936 | A * | 3/1997 | Kohler et al. | 428/107 |
| 6,140,260 | A * | 10/2000 | Johnson et al. | 139/383 A |
| 6,159,880 | A * | 12/2000 | Schiel | 162/358.2 |
| 6,723,208 | B1 * | 4/2004 | Hansen | 162/358.2 |
| 6,766,817 | B2 | 7/2004 | da Silva | 137/1 |

FOREIGN PATENT DOCUMENTS

| | | |
|---|---|---|
| WO | WO 98/56982 | * 12/1998 |

* cited by examiner

*Primary Examiner*—Eric Hug
(74) *Attorney, Agent, or Firm*—Taylor & Aust, P.C.

(57) ABSTRACT

An anti-rewet fabric is used for carrying a fiber web through an air press. The ant-rewet fabric includes at least one air distribution fabric layer, one air distribution fabric layer being configured for contacting the fiber web, and a perforated film layer and/or a spectra membrane, at least the perforated film layer being made of a polymeric or polyester film. At least the perforated film layer has a first film side and a second film side, the first film side being one of laminated and attached to the one air distribution fabric layer.

52 Claims, 4 Drawing Sheets

ANTI-REWET FELT FOR USE IN A PAPERMAKING MACHINE

CROSS REFERENCE TO RELATED APPLICATIONS

This is a continuation of PCT application No. PCT/EP02/10771, entitled "An anti-rewet felt for use in a papermaking machine", filed Sep. 25, 2002, which is a continuation of U.S. application Ser. No. 09/964,720, now U.S. Pat. No. 6,616,812, filed on Sep. 27, 2001.

BACKGROUND OF THE INVENTION

1. Field of the Invention

The present invention relates to fabrics used in papermaking machines, and, more particularly, to fabrics used to carry fiber or, more particularly, paper webs through a drying press. The present invention is particularly advantageous for tissue paper.

2. Description of the Related Art

For many years attempts have been made to use external air pressure to force water out of a paper web. Rather than compress a sheet at a press nip to the point where hydraulic pressure drives water out, as is the case in normal wet pressing, it was reasoned that more water could be removed, and sheet bulk could be maintained, if air pressure could be applied to supplement roller nip generated hydraulic pressures. One such attempt involves providing a multi-roller or other structure forming an air press having a closed chamber, wherein air is circulated through the chamber to convect moisture out of the paper web. Such air presses typically carry the paper web sandwiched between an upper pressing fabric and a lower anti-rewet layer.

Much attention has been given to the design of the pressing fabric and its characteristics. The construction of the pressing fabric has been thought to be the most important of the above-mentioned fabrics since it controls mechanical pressure on the paper web and the air flow therethrough. However, experimentation has shown the importance of the underneath anti-rewet layer. It has been found that rewet can have a profound effect on sheet solids after pressing. Specifically, the quality of the paper web has been found to decrease with increasing rewet. Sheet rewet can be controlled by the design of the anti-rewet layer.

What is needed in the art is an anti-rewet layer for use in air presses which can effectively minimize the amount of rewet which occurs in a fiber web during and after pressing thereof in a drying press.

SUMMARY OF THE INVENTION

The present invention provides an anti-rewet fabric or felt that includes at least one air distribution layer laminated or otherwise attached to a perforated film layer and/or a spectra membrane, the anti-rewet fabric having a low enough permeability and constructed so that water cannot be attracted back into a fiber web carried thereby through an air press.

The invention comprises in one form thereof, an anti-rewet felt for carrying a fiber web through an air press. The anti-rewet felt includes at least one air distribution layer, one air distribution layer being configured for contacting the fiber web, and a perforated film layer and/or a spectra membrane, at least the perforated film layer being made of a polymeric or a polyester film or any other film or the like. The perforated film layer has a first film side and a second film side, the first film side being one of laminated and attached to the one air distribution layer. If a spectra membrane is used, preferably the same may be the case with this spectra membrane.

Such a spectra membrane can in particular have the design and be manufactured as is described in GB 2 305 156 A, in connection with FIG. 3 therein, or as described and in GB 2 235 705 B. The two publications just mentioned are herewith incorporated by reference in the content of the present application.

The spectra membrane can therefore in particular be a membrane having a regular, non-woven structure through which suction is possible. It can be provided with spun reinforcement threads which extend through the mesh structure in the running direction of the web (cf. in particular FIG. 3 of GB 2 305 156 A). This spectra membrane can in particular be a porous, reinforced membrane made of a composite material, with spun threads or yarns extending in the machine direction forming the reinforcement elements, and the surrounding matrix material containing fluid passages and fully encapsulating the spun threads and connecting together spun thread by spun thread in order to produce the non-woven spectra membrane (cf. in particular GB 2 235 705 B). The spectra membrane can also in particular be designed and manufactured in other respects as is described in GB 2 305 156 A and GB 2 235 705 B.

In another form thereof, the invention comprises a papermaking machine for making a fiber web. The papermaking machine includes a plurality of conveyor rolls for carrying the fiber web and first and second opposing press elements. The first press element and second press element together form a nip therebetween. The papermaking machine further includes at least a first anti-rewet layer configured for carrying the fiber web through the nip. The first anti-rewet felt includes at least one air distribution fabric layer, one air distribution fabric layer being configured for contacting the fiber web, and a perforated film layer and/or a spectra membrane, at least the perforated film layer being made of a polymeric or polyester film or any other film or the like. The perforated film layer has a first film side and a second film side, the first film side being one of laminated and attached to the one air distribution fabric layer, the second film side being directed toward one press element. If a spectra membrane is used, preferably the same may be the case with this spectra membrane.

In another form thereof, the invention comprises a method of conveying a fiber web into an air press, the air press having a nip. The method includes the step of providing an anti-rewet felt for carrying the fiber web through an air press. The anti-rewet felt includes at least one air distribution fabric layer configured for contacting the fiber web and a perforated film layer and/or a spectra membrane, the perforation film layer being made of a polymeric or polyester film, or any other film or the like. The perforated film layer has a first film side and a second film side, the first film side being one of laminated and attached to one the air distribution fabric layer and/or a spectra membrane. The method further includes the step of carrying the fiber web on one air distribution fabric layer of the anti-rewet felt into the air press through the nip.

An advantage of the present invention is rewet of the fiber web after water has been removed therefrom can be greatly minimized.

A further advantage is that the perforated film layer and/or the spectra membrane of the anti-rewet felt or fabric increases the average air flow path length through the fabric.

BRIEF DESCRIPTION OF THE DRAWINGS

The above-mentioned and other features and advantage of this invention, and the manner of attaining them, will become more apparent and the invention will be better understood by reference to the following description of embodiments of the invention taken in conjunction with the accompanying drawings, wherein.

Figure 1:
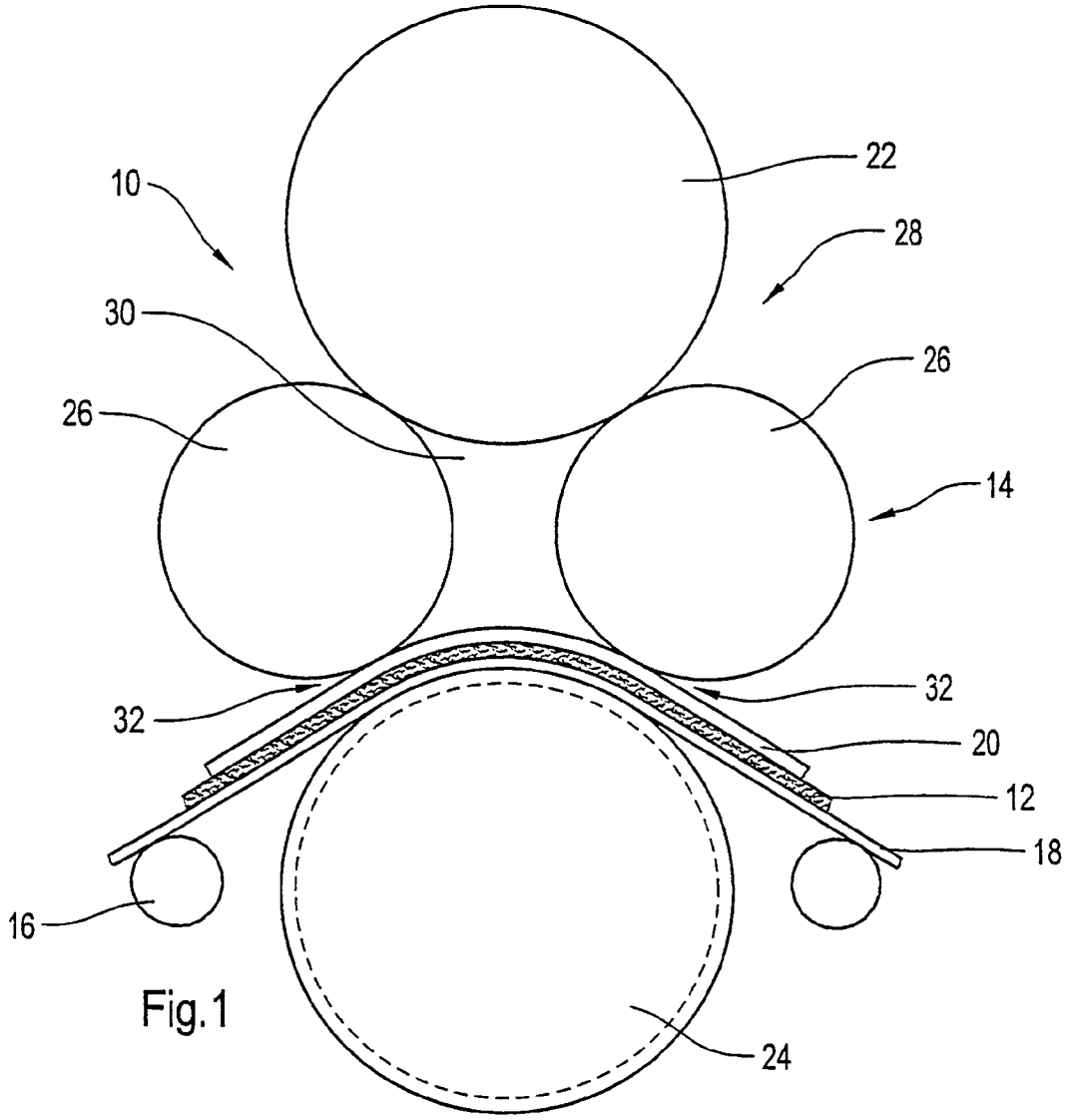
FIG. 1 is a side view of a first embodiment of a papermaking machine of the present invention.

Corresponding reference characters indicate corresponding parts throughout the several views. The exemplifications set out herein illustrate at least one preferred embodiment of the invention, in one form, and such exemplifications are not to be construed as limiting the scope of the invention in any manner.

DETAILED DESCRIPTION OF THE INVENTION

Referring now to the drawings, and more particularly to FIG. 1, there is shown a papermaking machine 10 for forming a fiber web 12 which generally includes an air press 14, a plurality of conveyor rolls 16, and press unit clothing including a first fabric 18 and a second fabric 20.

Air press 14 includes a first main roll 22, a second main roll 24, and a pair of cap rolls 26. First main roll 22 and cap rolls 26 together define an enclosure 28. Second main roll 24 acts as a counter element for enclosure 28. Enclosure 28 and second main roll 24 conjunctively define air press chamber 30 with air press chamber 30 having a pressurized fluid or gas (e.g. air, steam or a heated gas) therein. Second main roll 24 coacts with each of cap rolls 26 to define a pair of nips 32 through which first fabric 18, second fabric 20 and paper web 12 are conveyed. Second main roll 24 is a vented roll, a vented roll being a roll that is at least one of vented, grooved, blind drilled, drilled or connected to a source of suction in order to promote drainage therethrough.

Conveyer rolls 16 and second main roll 24 together carry first fabric 18, second fabric 20 and paper web 12 to, through and beyond air press 14. First fabric 18 is positioned between paper web 12 and second main roll 24, while second fabric 20 is arranged between paper web 12 and air press chamber 30.

Figure 2:
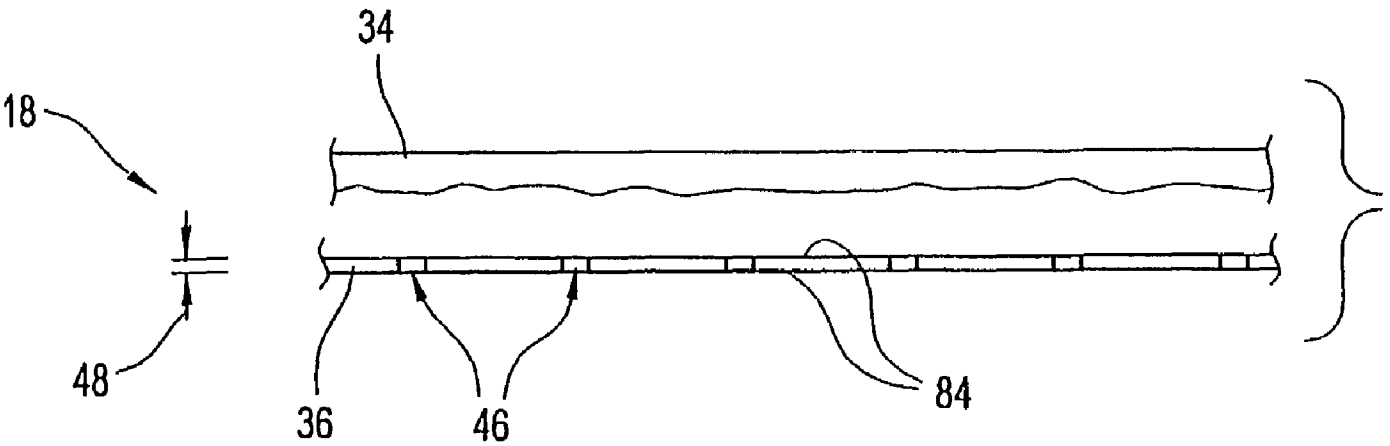
FIG. 2 is a schematic, exploded side view of the first fabric shown in FIG. 1.

First fabric 18 is an anti-rewet fabric or felt and is at least a two-layer fabric. First fabric 18 is designed so that water cannot be readily attracted back into fiber web 12 by web sheet expansion or web sheet capillary forces. First fabric 18 includes at least one air distribution fabric layer 34 (FIG. 2) and a perforated film layer 36, one air distribution fabric layer 34 being configured for contacting fiber web 12. Conversely, perforated film layer 36 should always be kept away from paper web 12 so as to not adversely affect the paper forming process. As an anti-rewet fabric, first fabric 18 is configured for promoting a one-way flow of water therethrough, allowing first fabric 18 to be used to direct the flow of water away from fiber web 12.

Figure 8:
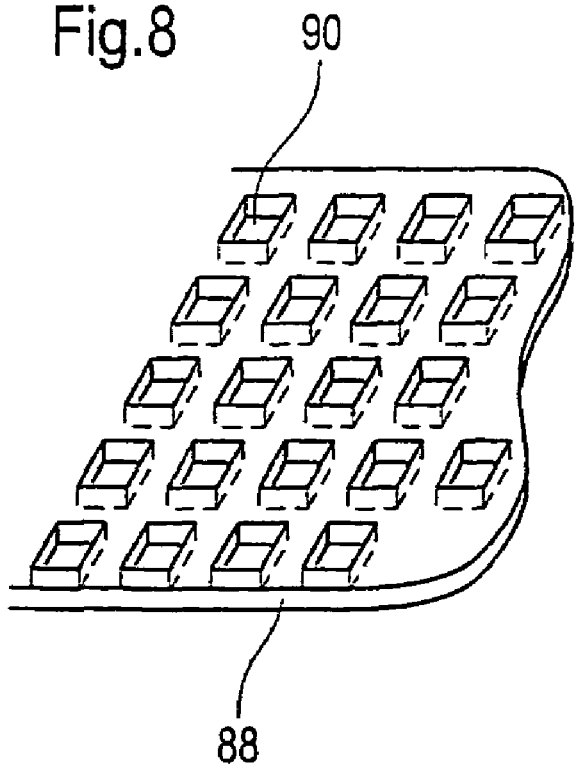
FIG. 8 is a schematic partial view of an exemplary embodiment of a spectra membrane.

Instead of or in addition to the perforated film layer 36 a spectra membrane could be used. A schematic partial view of an exemplary embodiment of a spectra membrane 88 is shown in FIG. 8. The spectra membrane 88 has the thickness d and can, for example, comprise holes 90.

Such a spectra membrane also works in the anti-rewet layer. Some good results could be achieved where a fabric has been laminated to the spectra membrane. The spectra grid acts like the perforated layer.

The spectra membrane provides a void structure that holds water away from the diffusion layer. The spectra voids provide a protected, quiet area for the water to reside as the fabric travels around rolls at high speed. The spectra membrane can have open areas that are quite large. The open area should be limited so that water speeds up and is ejected from the diffusion layer. The amount of speed needed to do this depends on air flow, and capillary structure of the diffusion layer. The structure needs to break water contact with the diffusion layer, and then the water should be captured in the backside fabric.

Figure 4:
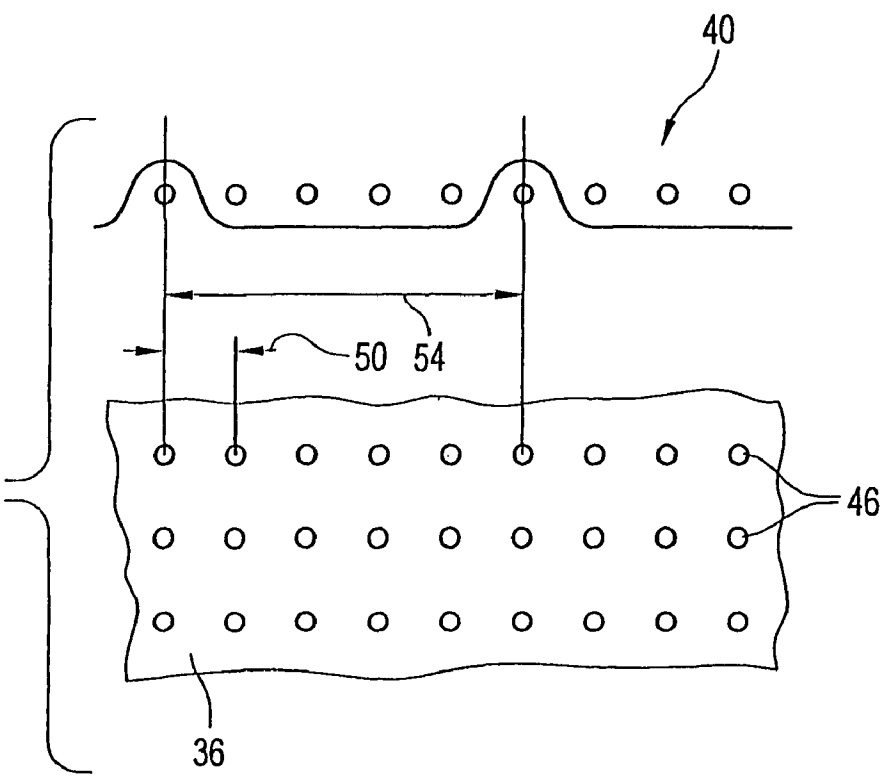
FIG. 4 is a schematic, exploded view of a second embodiment of the first fabric shown in FIG. 2.
Figure 3:
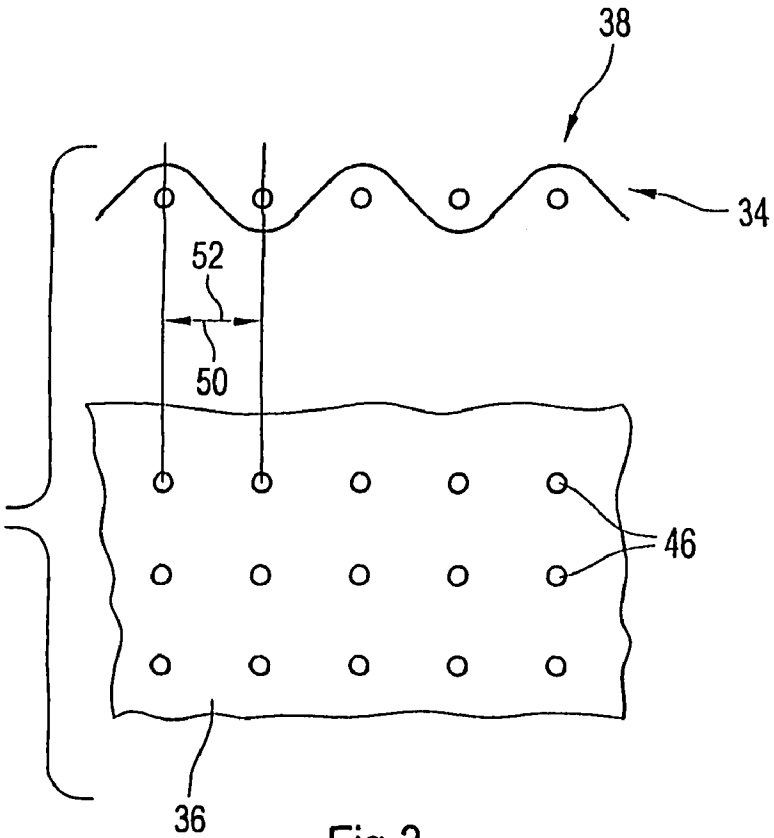
FIG. 3 is a schematic, exploded view of a first embodiment of the first fabric shown in FIG. 2.

Each air distribution fabric layer 34 is advantageously a polyester fabric and a sateen fabric favorably. A plain weave 38 (FIG. 3) may be used for each air distribution fabric layer 34, but a multi-float weave 40 (FIG. 4) is preferred. Multi-float weave 40 is also known as a multi-shed weave with a five-shed weave, in particular, being illustrated in FIG. 4. Multi-float weave 40 is preferred because such a weave provides for a longer flow path of air and thereby has a higher distribution effect associated therewith. Alternatively, each air distribution layer 34 may be formed of a non-woven fabric, so long as such fabric spreads the air sufficiently. One air distribution fabric layer 34 found to be favorable has a sateen weave, a thickness of about 0.022 inches, when combined with a perforated layer with, a hole pattern of about 300 holes/sq. inch and an open area of about 19%, resulting in an air permeability of about 40 cfm, or a comparable spectra membrane.

Air distribution fabric layer 34 adjacent paper web 12 is favorably a fabric that holds low amounts of water and provides adequate airflow and fabric dewatering. The more resistive such air distribution fabric layer 34 is to airflow, the more back pressure there is, and, hence, the less water is removed from paper web 12. It is desired not to impede the flow of water out of paper web 12, so the permeability of the materials used for such air distribution fabric layer 34 should be high enough to provide for adequate fabric dewatering. If the permeability thereof is too high, however, the sheet side of air distribution fabric layer 34 will not dewater well since air will take short circuit paths therethrough, leaving water therein.

Perforated film layer 36 favorably is a polymeric or polyester film (e.g. a film of material sold under the trade name "Mylar"®) or a plastic film and has a first film side 42 and a second film side 44. For example, first a polymeric or polyester film is coated with adhesive on one or both sides, and then the structure is perforated. First film side 42 is one of laminated and attached to air distribution fabric layer 34 configured for contacting fiber web 12. Perforated film layer 36 has a plurality of perforate holes 46 formed therein. Perforated film layer 36 preferably includes more than about 40,000 holes/m2 and more preferably more than about 200,000 holes/m2, thereby resulting in an open area in the approximate range of 1 to 30%, preferably 5 to 15%.

Perforated film layer 36 preferably has a film thickness 48 of less than about 0.04 inches and ideally less than about 0.005 inches.

In perforated film layer 36, each set of most-closely spaced perforate holes 46 is separated by a perforate distance 50. Additionally, each air distribution fabric layer 34 has one of plain weave 38 and a multi-float weave 40 associated therewith, plain weave 38 having a plain weave repeat distance 52 and multi-float weave 40 having a multi-float weave repeat distance 54. In order to maximize air distribution, plain weave repeat distance 52 and multi-float weave repeat distance 54 each are preferably at least substantially equal to and, most preferably, greater than perforate distance 50. In fact, the weave pattern chosen for each air distribution fabric layer 34 favorably should spread air further than perforate distance 50. As such, long floats in the weave pattern promote good spreading. In the embodiments illustrated in FIG. 3 and FIG. 4, plain weave repeat distance 52 is equal to perforate distance 50, and multi-float weave repeat distance 54 is greater than perforate distance 50.

First fabric 18 works as an anti-rewet layer because the air pressure forces water in paper web 12 and first fabric 18 to pass through perforate holes 46, with the water then being deposited on the side of perforate film layer 36 facing away from paper web 12. The flow of air also causes a break in the contact between this water, paper web 12 and air distribution fabric layer 34 adjoining paper web 12. Because of this break, water is not attracted back in the air distribution fabric layer 34 by capillary forces to rewet paper web 12. It is necessary to have adequate space for the water to reside after it passes through perforate holes 46, so the open area (not labeled) of perforate film layer 34 and the perforate hole size cannot be too big. As mentioned above, a spectra membrane can be provided instead of or in addition to said perforated film layer 36.

In principle, anti-rewet fabrics having more than two layers could also be used. The two layer structure works very well. However, it can be improved upon. For example:

The perforated backside layer (e.g. layer 36 in FIG. 2), does not have receptacles for the water. Water will pass back into the diffusion or air distribution fabric layer if the backside water is disturbed, which easily happens at high speed. The addition of a third backside layer that is very coarse can help protect the water layer.

The backside perforations do not distribute the air as it flows into the vented roll. If a perforation is over a land area in the roll, no air will flow through that perforation. To prevent this, the roll surface should be rough, or a fabric layer can be used to distribute the air.

Figure 7:
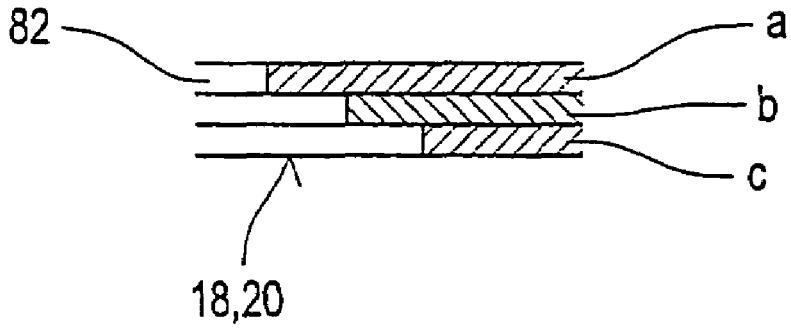
FIG. 7 is a schematic, partial view of a multi-layer anti-rewet structure which allows splices to be made.

A multi-layer anti-rewet structure allows on to make splices 82 (cf. FIG. 7). Each layer a, b, c, . . . can be cut yet the other layers will continue to carry the load if they are not all cut in the same area.

Such a multi layer structure could be, for example, as follows: air distribution layer/perforated film layer and/or spectra membrane/air distribution layer/perforated film layer and/or spectra membrane. Preferably a final backside water holding air distribution layer is provided. The final backside layer holds the water and diffuses the air. This works similarly as well as the two layer structure. The long path and directed flow by the perforations in this structure helps to reduce rewet.

In principle, a perforated film layer 36 can comprise a polymeric or polyester film coated with adhesive 84 (cf., e.g., FIG. 2) on one or both sides, and holes 46 put through both the polymeric or polyester film and the adhesive 84.

Thus, in a suitable manufacturing method, first a polymeric or polyester film is coated with adhesive on one or both sides, and thereafter the composite structure is perforated. This method puts holes through both the film and the adhesive.

Figure 5:
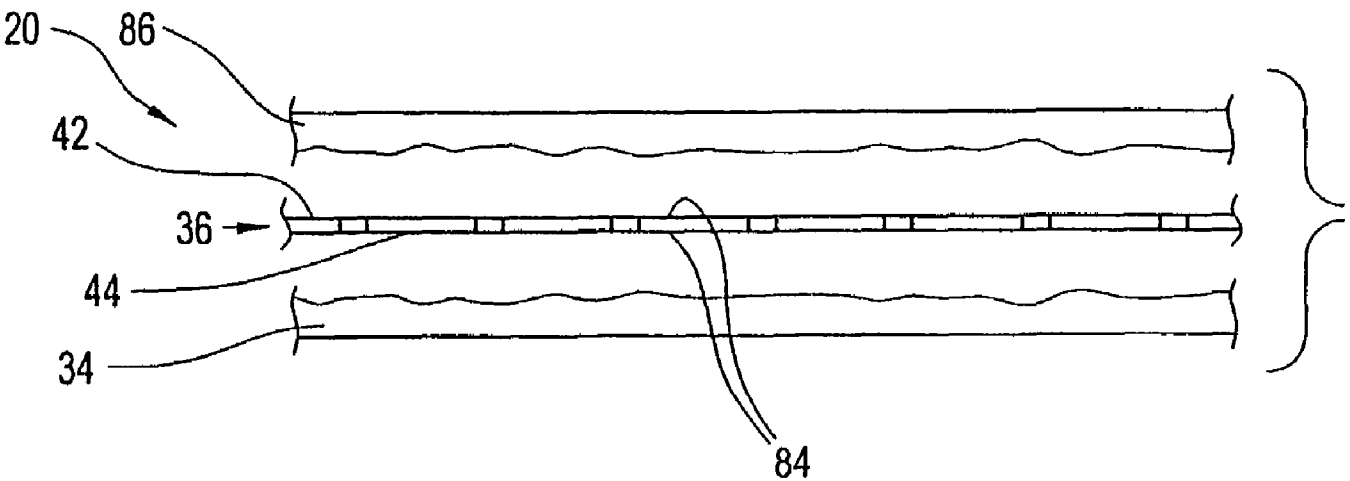
FIG. 5 is a schematic, exploded view of the second fabric shown in FIG. 1.

Second fabric 20 is advantageously an anti-rewet fabric or felt of similar construction and properties as first fabric 18, except for certain features discussed herein. Second fabric 20 favorably acts as a transfer fabric for transferring fiber web 12 to a next station (not shown) of papermaking machine 10. Second fabric 20, as seen from FIG. 5, is a three-layer fabric having a resistance layer 86, a perforated layer 36 and an air distribution fabric layer 34.

The resistance layer 86 is toward the chamber 30, and the distribution fabric layer 34 is toward the sheet of paper. The purpose of the membrane layer 20 is to limit air flow. The flow resistance layer 86 and perforations together act to limit the flow, since air flows only in the hole area.

Perforated layer 36 again can be coated with adhesive. Resistance layer 86 and air distribution fabric layer 34 are attached to first film side 42 and second film side 44 of perforated film layer 36, respectively, with the adhesive layers bonding the entire structure together. First fabric 18 and second fabric 20 have a first permeability and a second permeability, respectively, the first permeability being equal to or greater than the second permeability. Normally it is desired to press the sheet to gain additional water removal. To do this, fabric 20 preferably should have the lowest permeability practical, and fabric 18 preferably should have the highest permeability practical, so the combine permeability limits the air flow to the needed amount. Second fabric 20 need not be an anti-rewet layer to achieve adequate results. Second fabric 20 could instead, for example, be a permeable material.

Second fabric 20 could be used in lieu of first fabric 18 in a design in which only one such fabric is used.

Advantageously, at least one of first fabric 18 and second fabric 20 is an embossed imprinting fabric that is able to give fiber web 12 a three-dimensional structure such as raised or indented lettering and/or an embossed decorative design. The presence of a three-dimensional structure is advantageous in the production of towel tissue in a tissue paper machine, helping to increase the water absorbency capacity and rate. Preferably, first fabric 18 and/or second fabric 20 would be an imprinting fabric. If a spectra membrane is used, this spectra membrane having a molded structure could be molded with the pattern needed.

In operation, fiber web 12 is carried between first fabric 18 and second fabric 20 into one nip 32 of air press 14 by conveyor roll 16. Once inside air press chamber 30 of air press 14, the air pressure within air press chamber 30, as well as the mechanical pressure exerted at each of nips 32, forces water out of fiber web 12 as it is conveyed upon second main roll 24. Since first fabric 18 and second fabric 20 are anti-rewet felts or fabrics, the water forced out of fiber web 12 is substantially unable to return to and thus rewet fiber web 12. Fiber web 12 is conveyed out of air press 14 through another nip 32 toward a further conveyor roll 16. Conveyor roll 16 helps propel fiber web 12 toward a next processing station (not shown).

Figure 6:
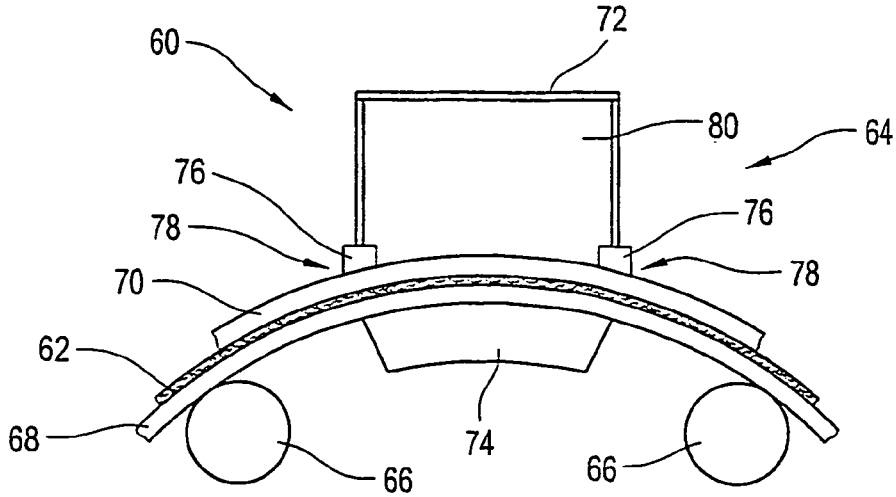
FIG. 6 is a side view of a second embodiment of a papermaking machine of the present invention.

A second embodiment of a papermaking machine is shown in FIG. 6. Papermaking machine 60 for forming a fiber web 62 generally includes an air press 64, a plurality of conveyor rolls 66, a first fabric 68 and a second fabric 70. Papermaking machine 60 differs from papermaking machine 10 with respect to the air press employed by each. Consequently, only those features related to air press 64 and the operation thereof are discussed in any detail with respect to this embodiment.

Air press 64 includes a box enclosure 72 and an adjacently positioned counter element 74. Counter element 74 is a shoe, a vented box or a suction box (such terms often being used somewhat interchangeably in the art). Box enclosure 72 has a plurality of seals 76 mounted thereon adjacent counter element 74. Seals 76 of box enclosure 72 and counter element 74 together define a plurality of nips 78 through which fiber web 62, first fabric 68 and second fabric 70 are able to pass. Box enclosure 72 and counter element 74 together define air press chamber 80. Air press chamber 80, like air press chamber 30, has a pressurized fluid therein.

In principle, it is possible to make membranes with more than three layers. It would be possible to have a multi layer membrane with the following construction where each successive layer adds to the total resistance of the structure: resistive layer/perforated film layer and/or spectra membrane/air distribution fabric layer/perforated film layer and/or spectra membrane/air distribution fabric layer.

Permeability can, e.g., be varied or controlled by changing the registration of the holes in the successive perforation layers in a multi layer membrane. For example, in the multi layer structure as mentioned before, it would be possible to adjust the permeability at the time of manufacture, by offsetting the holes in the two perforation layers. With the two perforation layers' holes lined up, the permeability would be higher than if the perforations do not line up.

As can be seen from the above, preferably a pressurized zone is used. Such a pressurized zone is much more effective than a vacuum box to create air flow. The air pressure in the chamber drives the flow of air so that no vacuum box is needed. Only a 'vent' box is needed to collect the air and exhaust it to atmospheric pressure. Suction is not necessary, but could be used.

While this invention has been described as having a preferred design, the present invention can be further modified within the spirit and scope of this disclosure. This application is therefore intended to cover any variations, uses, or adaptations of the invention using its general principles. Further, the application is intended to cover such departures from the present disclosure as come within known or customary practice in the art to which this invention pertains and which fall within the limits of the appended claims.

What is claimed is:

1. A press unit for dewatering a fiber web, said press unit comprising:

first and second opposing press elements, said first press element and said second press element together forming a nip therebetween wherein said first press element is an enclosure containing pressurized fluid and said second press element is a counter element positioned opposite said enclosure;

at least one anti-rewet fabric configured for carrying the fiber web through said nip, each said anti-rewet fabric having a first fabric side and a second fabric side, each said anti-rewet fabric including:

at least one air distribution fabric layer, one air distribution fabric layer being configured for contacting the fiber web; and at least one of a perforated film layer and a spectra membrane, said at least one of a perforated film layer and a spectra membrane being comprised of one of a polymeric film, a polyester film and a plastic film, said at least one of a perforated film layer and a spectra membrane having a first film side and a second film side, said first film side being one of laminated and attached to said one air distribution fabric layer, said second film side being directed toward said counter element;

said press unit further comprising a second fabric having a permeability being one of equal and less than a permeability of said at least one anti-rewet fabric; and said at least one anti-rewet fabric being arranged between the fiber web and said counter element and said second fabric being arranged between the fiber web and said enclosure.

2. The press unit of claim 1, wherein the structure of said spectra membrane is such that water contact with the distribution fabric layer is broken.

3. The press unit of claim 1, wherein said anti-rewet fabric comprises more than two layers.

4. The press unit of claim 3, wherein said anti-rewet fabric comprises a third backside layer.

5. The press unit of claim 3, wherein a backside air distribution fabric layer is provided.

6. The press unit of claim 1, including a vented roll disposed on the backside of the anti-rewet fabric, and said vented roll has a rough surface.

7. The press unit of claim 1, wherein said anti-rewet fabric comprises a multi layer structure as follows: air distribution layer/perforated film layer and/or spectra membrane/air distribution layer/perforated film layer and/or spectra membrane.

8. The press unit of claim 7, wherein a final backside water holding air distribution layer is provided.

9. The press unit of claim 1, wherein said perforated film layer comprises one of a polymeric film layer and a polyester film layer coated with adhesive on at least one side, and holes through both the perforated film layer and the adhesive.

10. The press unit of claim 1, wherein said pressurized fluid is at least one of air, steam and a heated gas.

11. The press unit of claim 1, wherein said enclosure includes three juxtaposed rolls and said counter element is a fourth roll further juxtaposed to said three juxtaposed rolls of said enclosure, said press unit thereby defining a four-roll press arrangement.

12. The press unit of claim 1, wherein said enclosure is a box having a pressurized fluid therein, and said counter element is one of a roll, a shoe, a vented box and a suction box.

13. The press unit of claim 1, wherein said counter element is one of a roll, a shoe and a vented box.

14. The press unit of claim 13, wherein said counter element is a roll, said roll being at least one of vented, grooved, blind drilled, drilled, and connected to a source of suction.

15. The press unit of claim 1, wherein said at least one anti-wet fabric includes a first anti-rewet fabric, said press unit further comprising a second fabric, said first anti-wet fabric being configured so as to be arranged between the fiber web and said counter element, said second fabric configured so as to be arranged between the fiber web and said enclosure.

16. The press unit of claim 15, wherein the press unit is part of a papermaking machine, one of said second fabric and said first fabric being configured for transferring the fiber web to a next station of said papermaking machine.

17. The press unit of claim 1, wherein said first anti-wet fabric and said second fabric have a first permeability and a second permeability, respectively, said first permeability being one of equal to and greater than said second permeability.

18. The press unit of claim 1, wherein said second fabric comprises a resistive layer, at least one of a perforated film layer and a spectra membrane, and an air distribution fabric layer.

19. The press unit of claim 18, wherein said resistive layer is toward the first press element and said air distribution fabric layer is toward the fiber web.

20. The press unit of claim 1, wherein said second fabric comprises more than three layers.

21. The press unit of claim 20, wherein said second fabric comprises a multi layer structure as follows: resistive layer/perforated film layer and/or spectra membrane/air distribution fabric layer/perforated film layer and/or spectra membrane/air distribution fabric layer.

22. The press unit of claim 1, wherein at least one of said fabric comprises at least two of a perforated film layer and a spectra membrane, and the permeability thereof is adjusted by the registration of the holes.

23. The press unit of claim 1, wherein at least one of said fabric is constructed for pattern pressing.

24. The press unit of claim 23, wherein said at least one fabric constructed for pattern pressing comprises a spectra membrane molded with the pattern.

25. An anti-rewet fabric for carrying a fiber web through an air press, the anti-rewet fabric comprising:

at least one air distribution fabric layer, one said air distribution fabric layer being configured for contacting the fiber web;

at least one of a perforated film layer and a spectra membrane, at least said perforated film layer being comprised of one of a polymeric film, a polyester film and a plastic film, at least said perforated film layer having a first film side and a second film side, said first film side being one of laminated and attached to said one said air distribution fabric layer, wherein each said air distribution fabric layer includes one of a plain weave and a multi-float weave; and wherein said perforated film layer has a series of perforate holes therein, each set of most-closely spaced perforate holes being separated by a perforate distance, each said air distribution fabric layer having a fabric weave associated therewith, said fabric weave having a weave repeat distance, said weave repeat distance being one of equal to and greater than said perforate distance.

26. The anti-rewet fabric of claim 25, wherein said anti-rewet fabric comprises more than two layers.

27. The anti-rewet fabric of claim 26, wherein said anti-rewet fabric comprises a third backside layer.

28. The anti-rewet fabric of claim 26, wherein a backside air distribution fabric layer is provided.

29. The anti-rewet fabric of claim 25, further comprising a multi layer structure as follows: air distribution layer/perforated film layer and/or spectra membrane/air distribution layer/perforated film layer and/or spectra membrane.

30. The anti-rewet fabric of claim 29, wherein a final backside water holding air distribution layer is provided.

31. The anti-rewet fabric of claim 25, wherein said perforated film layer comprises one of a polymeric film and a polyester film coated with adhesive on one or both sides, and holes put through both the perforated film layer and the adhesive.

32. The anti-rewet fabric of claim 25, wherein each said air distribution fabric layer includes a multi-float weave.

33. The anti-rewet fabric of claim 25, wherein said weave repeat distance is greater than said perforate distance.

34. The anti-rewet fabric of claim 25, wherein said perforated film layer has a series of perforate holes therein, said perforated film layer having about at least 40,000 holes/m2.

35. The anti-rewet fabric of claim 25, wherein said perforated film layer has a series of perforate holes therein, said perforated film layer having about at least 200,000 holes/m2.

36. The anti-rewet fabric of claim 25, wherein said at least one of a perforated film layer and a spectra membrane has an open area in the approximate range of 1% to 30%.

37. The anti-rewet fabric of claim 25, wherein said at least one of a perforated film layer and a spectra membrane has an open area in the approximate range of 5% to 15%.

38. The anti-rewet fabric of claim 25, said at least one of a perforated film layer and a spectra membrane has a thickness of less than about 0.04 inches.

39. The anti-rewet fabric of claim 38, wherein said at least one of a perforated film layer and a spectra membrane has a thickness of less than about 0.005 inches.

40. The anti-rewet fabric of claim 25, wherein each air distribution fabric layer is made of a sateen fabric.

41. A clothing for a press unit for dewatering a fiber web, comprising;

at least one anti-rewet fabric having at least one air distribution fabric layer, one said air distribution fabric layer being configured for contacting the fiber web; and at least one of a perforated film layer and a spectra membrane, at least said perforated film layer being comprised of one of a polymeric film, a polyester film and a plastic film, at least said perforated film layer having a first film side and a second film side, said first film side being one of laminated and attached to said one said air distribution fabric layer, wherein said at least one anti-rewet fabric includes a first anti-rewet fabric and said clothing further comprises a second fabric.

42. The clothing of claim 41, wherein said second fabric comprises a resistive layer, at least one of a perforated film layer and a spectra membrane, and an air distribution fabric layer.

43. The clothing of claim 41, wherein said second fabric comprises more than three layers.

44. The clothing of claim 43, wherein said second fabric comprises a multi layer structure as follows: resistive layer/perforated film layer and/or spectra membrane/air distribution fabric layer/perforated film layer and/or spectra membrane/air distribution fabric layer.

45. The clothing of claim 41, wherein at least one fabric comprises at least two of a perforated film layer and a spectra membrane, and the permeability thereof is adjusted by the registration of holes.

46. The clothing of claim 41, wherein at least one fabric is constructed for pattern pressing.

47. The clothing of claim 46, wherein said fabric constructed for pattern pressing comprises a spectra membrane molded with the pattern.

48. A method of conveying a fiber web into an air press, said air press having a nip formed between a first press element and a second press element, said method comprising the steps of:

providing said first press element as an enclosure containing pressurized fluid, and said second press element as a counter element positioned opposite said enclosure;

providing an anti-rewet fabric for carrying the fiber web through said air press, said anti-rewet fabric comprising:

at least one air distribution fabric layer configured for contacting the fiber web; and at least one of a perforated film layer and a spectra membrane, at least said perforated film layer being comprised of one of a polymeric film, a polyester film and a plastic film, at least said perforated film layer having a first film side and a second film side, said first film side being one of laminated and attached to one said air distribution fabric layer;

providing a second fabric having a permeability that is one of equal and less than a permeability of said at least one anti-rewet fabric; and carrying the fiber web on one said air distribution fabric layer of said anti-rewet fabric into said air press through said nip with said anti-rewet fabric between the fiber web and the counter element and the second fabric between the fiber web and the enclosure.

49. A papermaking machine for making a fiber web, said papermaking machine comprising:

a plurality of conveyor rolls for carrying the fiber web;

first and second opposing press elements, said first press element and said second press element together forming a nip therebetween wherein said first press element is an enclosure containing pressurized fluid and said second press element is a counter element positioned opposite said enclosure;

at least a first anti-rewet fabric configured for carrying the fiber web through said nip, said first anti-rewet fabric including:

at least one air distribution fabric layer, one said air distribution fabric layer being configured for contacting the fiber web; and at least one of a perforated film layer and a spectra membrane, at least said perforated film layer being comprised of one of a polymeric film and a polyester film, at least said perforated film layer having a first film side and a second film side, said first film side being one of laminated and attached to one said air distribution fabric layer, said second film side being directed toward said counter element;

said press unit further comprising a second fabric having a permeability being one of equal and less than a permeability of said at least one anti-rewet fabric; and said at least one anti-rewet fabric being arranged between the fiber web and said counter element and said second fabric being arranged between the fiber web and said enclosure.

50. A method for dewatering a fiber web, the fiber web initially containing water therein, said method comprising the steps of:

providing an air press for dewatering the fiber web, said air press having a nip and an air pressure chamber, said air pressure chamber having air under pressure therein;

providing a first fabric and a second fabric for carrying the fiber web through said air press, the second fabric having a permeability being one of equal and less than a permeability of the first fabric;

carrying the fiber web between said first fabric and said second fabric through said nip and into said air pressure chamber of said air press with the second fabric between the fiber web and the air pressure chamber; and displacing the water initially contained in said fiber web with the air in said air pressure chamber.

51. The method of claim 50, wherein at least said first fabric is an anti-rewet fabric, said anti-rewet fabric being configured for promoting only a one-way flow of water therethrough, said one-way flow being directed away from the fiber web.

52. The method of claim 50, wherein at least one of said first fabric and said second fabric has a three-dimensional structure configured for creating an imprint thereof in the fiber web.

* * * * *

UNITED STATES PATENT AND TRADEMARK OFFICE

CERTIFICATE OF CORRECTION

PATENT NO. : 7,323,087 B2
APPLICATION NO. : 10/810454
DATED : January 29, 2008
INVENTOR(S) : Beck It is certified that error appears in the above-identified patent and that said Letters Patent is hereby corrected as shown below:

COLUMN 9

At line 6, following "first", please insert --anti-rewet--; and

At line 37, please delete "fabric", and substitute therefore --fabrics--.

COLUMN 10

At line 53, please delete "A clothing", and substitute therefore --Clothing--.

Signed and Sealed this

Fourteenth Day of October, 2008

JON W. DUDAS
*Director of the United States Patent and Trademark Office*